United States Patent [19]

Forch

[11] 4,350,525

[45] Sep. 21, 1982

[54] MAGNETIC SUSPENSION RAILROAD PARTS

[75] Inventor: Karl Forch, Hattingen-Blankenstein, Fed. Rep. of Germany

[73] Assignee: Thyssen Aktiengesellschaft, Duisburg, Fed. Rep. of Germany

[21] Appl. No.: 242,470

[22] Filed: Mar. 11, 1981

[30] Foreign Application Priority Data

Mar. 11, 1980 [DE] Fed. Rep. of Germany ..... 3009234

[51] Int. Cl.[3] ..... C22C 38/06

[52] U.S. Cl. ..... 75/124; 75/125; 75/126 J; 75/126 Q; 104/286

[58] Field of Search ..... 75/124 B, 125, 126 J, 75/126 K, 126 Q; 104/286, 294

[56] References Cited

U.S. PATENT DOCUMENTS

| | | | |
|---|---|---|---|
| 2,845,345 | 7/1958 | Bauscher et al. | 75/125 |
| 3,110,798 | 12/1963 | Keay | 75/125 |
| 3,635,770 | 1/1972 | Sasaki et al. | 75/125 |
| 3,929,472 | 12/1975 | Okada et al. | 75/124 B |
| 4,032,333 | 6/1977 | Josefsson | 75/124 B |
| 4,266,974 | 5/1981 | Nitta et al. | 75/126 J |

*Primary Examiner*—John P. Sheehan

*Attorney, Agent, or Firm*—Kenyon & Kenyon

[57] ABSTRACT

A magnetic suspension railroad magnetically active part is made of steel with the following composition:

0 to 0.15—% carbon,
0 to 0.045—% phosphorus,
0 to 0.008—% nitrogen,
0.75 to 2.0—% silicon,
0.15 to 1.00—% manganese,
0.02 to 0.07—% aluminum, soluble,
0.25 to 0.55—% copper,
0.65 to 1.00—% chromium,
Remainder—iron with unavoidable impurities.

2 Claims, No Drawings

MAGNETIC SUSPENSION RAILROAD PARTS

Magnetic suspension railroad magnetically active parts, especially the lateral guide rails, must sustain support, steering and propulsion forces of magnetically suspended trains, and should be made of magnetically soft steel having high magnetic induction and high electric resistivity, magnetic aging stability, weather resistance and good weldability.

For magnetically active parts of electric machines, electrical silicon steels are customarily used. These may contain up to 0.10% carbon, up to 4% silicon, up to 0.5% manganese, less than 0.8% aluminum and the remainder, iron. While the known electrical steels have a high magnetic induction and high electric resistance, their weldability is poor and their weather resistance is insufficient, which is indispensable for welded parts which are installed or move outdoors.

While steels having an alloy content which is mainly intended for corrosion resistance, have high electric resistivity, their magnetic induction is insufficient because of their high alloy content. Their high content of relatively expensive alloying elements, especially chromium in the order of magnitude of 5 to 20%, further makes the use of these steels for suspension railroad parts with large material consumption all but impossible for cost reasons.

In connection with the development of magnetic suspension railroads, the structural steel type at St 37 has been used experimentally as material for support and guide elements. The unsatisfactory values of the electric resistance of this steel, however, lead to unjustifiable power losses. In addition, because of the lack of weather resistance of this steel, the necessity arises to apply protective paint. Protective paint applications to obtain weather resistance, however, are disadvantageous for all support and guide parts of magnetic suspension railroads. In the event of emergency braking of the train, brake shoes come into contact with these parts. A coat of protective paint would be destroyed in the process, reduces the braking performance and otherwise requires much maintenance.

It is now an object of the present invention to make such parts of a steel which, in addition to high magnetic induction and high electric resistivity, also exhibits magnetic aging stability, weather resistance and good weldability.

According to the invention, this object is attained by making the mentioned parts of a steel with by weight the following composition:

0 to 0.15—% carbon,
0 to 0.045—% phosphorus,
0 to 0.008—% nitrogen,
0.75 to 2.0—% silicon,
0.15 to 1.00—% manganese,
0.02 to 0.07—aluminum, soluble,
0.25 to 0.55—% copper,
0.65 to 1.00—% chromium,
Remainder—iron with unavoidable impurities.

Preferred is a steel with by weight the following composition:

0.05 to 0.08—% carbon,
0.005 to 0.02—% phosphorus,
0.006 to 0.008—% nitrogen,
1.60 to 1.80—% silicon,
0.30 to 0.40—% manganese,
0.040 to 0.07—% aluminum soluble, 0.25 to 0.35—% copper,
0.75 to 0.85—% chromium,
Remainder—iron with unavoidable impurities.

The steel for support and guide parts of magnetic suspension railroads, especially for their lateral guide rails, meets the following stringent requirements of a material for such parts:

- High magnetic flux density, especially in the region of higher field strengths, as is required to build up the magnetic fields of the necessary strength. Specified is, for instance, an induction of at least 1.5 T at a field strength of 4000 A/m;
- high resistivity of at least 0.3 ohm $mm^2/m$ at room temperature to assure low power consumption by low eddy current losses;
- good weather resistance as is required to maintain constant air gaps between the rail and the vehicle magnets, and
- good weldability, which is an indispensable prerequisite for welded structural parts.

The carbon content of the steel according to the invention is limited to 0.15% in order to ensure the necessary magnetic flux density.

For the same reason, the manganese content is limited to maximally 1.0%. A minimum manganese content is required to meet the requirement with respect to the electric resistance.

From the same aspect, a minimum silicon content of 0.75% is necessary. However, so as not to impair the magnetic behavior unduly, the silicon content must be limited to maximally 2.0%.

The relatively high silicon content further makes it possible to limit the addition of chromium, which is provided for ensuring the corrosion resistance, to maximally 1.0% to favor the magnetizability without loss of weather resistance. Higher Cr-contents degrade the magnetic induction noticeably.

For the same reason, the phosphorus content, which is necessary for the weather resistance, is set comparatively low with 0.045% maximum, whereby good weldability is ensured at the same time.

In addition to the aluminum content provided for complete binding of any nitrogen so as to prevent the formation of iron nitride impairing the magnetic properties, an excess of aluminum is to be present in the steel in order to increase the electric resistivity without adversely affecting the magnetic data. Complete binding of the nitrogen is essential to prevent a degradation of the magnetic properties (magnetic aging susceptibility) which is caused by nitrogen not bound by aluminum, in the event of temperature or mechanical stresses. Since the aluminum nitride content of the steel affects the magnetic induction of the material, it has been found to be advantageous to limit the nitrogen content of the steel to the value 0.008%.

In a steel with the silicon contents given, a comparatively small copper content is already sufficient to improve the corrosion resistance substantially. However, copper in an amount of 0.25 to 0.55% is required to obtain the weather resistance.

An addition of more than 0.55% Cu leads to a degradation of the magnetic properties such as induction and coercive force.

The mechanical properties of the steel according to the invention, such as elastic limit, tensile strength, deformation and fatique strength correspond to those of the St 37 grade.

To set optimum physical and mechanical properties, the steel according to the invention is normalized and optionally, annealed for stress relief.

Embodiment examples for the new steel are given in Table 1.

TABLE 1

| | C (%) | Si (%) | Mn (%) | P (%) | Al (%) | Cr (%) | Cu (%) | N (ppm) |
|---|---|---|---|---|---|---|---|---|
| Melt A | .05 | 1.78 | .32 | .012 | .047 | .78 | .33 | 80 |
| Melt B | .07 | 1.60 | .40 | .006 | .048 | .76 | .29 | 60 |
| Melt C | .07 | 1.69 | .40 | .009 | .064 | .80 | .26 | 70 |

From the following survey, the superiority of the steel according to the invention is seen over an unalloyed steel used for comparison which contains 0.07% carbon, 0.25% silicon, 0.39% manganese, 0.010% phosphorus, 0.016% aluminum, 0.07% chromium, 0.06% copper and the remainder iron.

TABLE 2

| Steel | | Magnetic Flux* in Tesla at 4000 A/m | Resistivity at Room Temperature in ohm mm²/m | Weather Resistance Weight Loss g/m²/year | Strength $R_m$ N/mm² | Elong. at Fract. A % |
|---|---|---|---|---|---|---|
| According to Invention | A | 1.584 | 0.406 | 88 | 480 | 30 |
| | B | 1.593 | 0.393 | 93 | | |
| | C | 1.588 | 0.405 | 90 | | |
| Comparison Steel (St 37) | | 1.642 | 0.175 | 150 | 450x | 23x |

x(DIN 17100)
*Density

I claim:

1. A magnetic suspension railroad part, especially a lateral guide rail, adapted to sustain the support, steering and propulsion forces of suspended railroad use, and made of a magnetically soft steel having high magnetic induction and electric resistivity, magnetic aging stability, weather resistance and good weldability, said steel consisting of:

0 to 0.15—% carbon,
0 to 0.045—% phosphorus,
0 to 0.008—% nitrogen,
0.75 to 2.0—% silicon,
0.15 to 1.00—% manganese,
0.02 to 0.07—% aluminum, soluble,
0.25 to 0.55—% copper,
0.65 to 1.00—% chromium,
Remainder—iron with impurities due to melting.

2. The part of claim 1 in which said steel consists of:

0.05 to 0.08—% carbon,
0.005 to 0.02—% phosphorus,
0.006 to 0.008—% nitrogen,
1.60 to 1.80—% silicon,
0.30 to 0.40—% manganese,
0.040 to 0.07—% aluminum, soluble,
0.25 to 0.35—% copper,
0.75 to 0.85—% chromium,
Remainder—iron including unavoidable impurities.

* * * * *